US005238510A

United States Patent [19]

Dutton et al.

[11] Patent Number: 5,238,510

[45] Date of Patent: Aug. 24, 1993

[54] METAL SHEET AND METHOD FOR PRODUCING THE SAME

[75] Inventors: Ronald J. Dutton, Hellertown, Pa.; Robert E. Forbes, Northville, Mich.; Herbert E. Townsend, Jr., Center Valley, Pa.

[73] Assignee: Bethlehem Steel Corporation, Bethlehem, Pa.

[21] Appl. No.: 802,386

[22] Filed: Dec. 4, 1991

Related U.S. Application Data

[62] Division of Ser. No. 565,097, Aug. 10, 1990, abandoned.

[51] Int. Cl.[5] ..... C21D 1/78

[52] U.S. Cl. ..... 148/531; 148/533; 148/639; 148/714

[58] Field of Search ..... 148/530–533, 148/639, 714

[56] References Cited

U.S. PATENT DOCUMENTS

| | | | |
|---|---|---|---|
| 1,870,577 | 8/1932 | Lamb | 148/601 |
| 2,256,947 | 9/1941 | Lewis | 148/566 |
| 3,267,252 | 8/1966 | Morris | 219/152 |
| 3,480,486 | 11/1969 | Tanaka et al. | 148/627 |
| 3,522,116 | 7/1970 | Coleman | 148/639 |
| 3,536,540 | 10/1970 | Rauch | 148/574 |
| 3,613,425 | 10/1971 | Roberts | 72/202 |
| 3,877,867 | 8/1975 | Tsuchiva et al. | 432/11.5 |
| 4,405,386 | 9/1983 | Mravic et al. | 148/714 |
| 4,571,637 | 2/1986 | Yamada et al. | 428/653 |
| 4,722,871 | 2/1988 | Radtke | 428/653 |

OTHER PUBLICATIONS

Metals Handbook, 9th edition, vol. 4, pp. 6–27, ASM, 1981.

The Making, Shaping, and Treating of Steel, 10th edition, pp. 1071–1073 and 1128–1129, AISE, 1985.

*Primary Examiner*—George Wyszomierski

*Attorney, Agent, or Firm*—Joseph W. Berenato, III; John I. Iverson; Harold I. Masteller, Jr.

[57] ABSTRACT

Disclosed is a method for producing a metal sheet having a full-hard central portion extending between at least two softer side edge portions of the sheet. The method comprises the step of heating the side edge portions of the sheet portions of the sheet to a higher temperature than the central portion.

21 Claims, 2 Drawing Sheets

METAL SHEET AND METHOD FOR PRODUCING THE SAME

This is a division of application Ser. No. 07/565,097 filed on Aug. 10, 1990, now abandoned.

BACKGROUND OF THE INVENTION

This invention relates to a method of producing a metal sheet product. It relates particularly to a method for producing a steel sheet that is hot-dip coated with zinc, tin, terne, aluminum, aluminum-zinc alloys and lead.

A hot-dip coating of zinc or other protective metals on steel sheet is produced by passing a suitably prepared cold rolled steel sheet through a bath containing the molten coating metal, such as a molten zinc. The coating of steel sheet is usually done on a continuous basis using one of several well developed coating processes.

One of the most common of the hot-dip coating processes in use today for coating steel sheet with zinc or zinc-aluminum alloy is the "Non-Oxidizing Process" as described in U.S. Pat. No. 3,320,085 assigned to Selas Corporation.

The "Non-Oxidizing Process" for galvanizing sheet steel includes passing a steel strip through a washing or pickling process to remove oil and dirt, followed by a water rinse which leaves a thin film of oxide coating on the steel strip. The strip is then passed through a gas fired furnace containing a reducing atmosphere which causes a reduction of the oxide coating on the surface of the steel strip and the formation of a tightly adherent impurity-free iron layer on the steel strip. The strip remains contained within the reducing atmosphere in the furnace and furnace enclosed snout until it is immersed in a molten zinc bath maintained at a temperature of about 850° F. (456° C.). The strip is then air cooled, resulting in a bright spangled surface characterized by several thin iron-zinc intermetallic layers between the steel base and a relatively thick overlay of free zinc.

One area of interest for hot-dip coating research has been the formability of the hot-dip coated sheet. Many applications for hot-dip coated sheet require a fairly ductile product and practices described in U.S. Pat. No. 4,287,008 to Torok, et al.; U.S. Pat. No. 3,297,499 to Mayhew; U.S. Pat. No. 3,111,435 to Graff, et al.; U.S. Pat. No. 3,028,269 to Beattie, et al. and U.S. Pat. No. 2,965,963 to Batz, et al. are all directed to improving the ductility of hot-dip coated steel sheet after it has been coated. These prior patents are directed to the practice of post annealing the entire coated sheet to effect changes in the base steel without changing the corrosion protection characteristics of the coating itself.

One large market for hot-dip coated steel sheet is the metal building industry where the coated steel sheet is used for roofing and siding panels on commercial and residential buildings. The hot-dip coated steel sheets used for roofing are usually corrugated or roll formed for strength and stiffness, and joined together at their edges by a continuous weatherproof lockseam. The sealing lockseam requires sufficient ductility in the steel sheet to allow for rather severe bends as the lockseam is formed. As a result, the metal building industry would like a highly corrosion resistant hot-dip coated steel sheet product exhibiting both good strength and stiffness characteristics, as well as suitable side edge ductility to facilitate edge forming at either the shop or in the field. Other product applications of such hot-dip coated steel sheets would be large containers or doors. These large products also require the hot-dip steel sheet to have good strength and stiffness, resistance to corrosion but also good formability at the edges of the sheet for making seams and connections.

SUMMARY OF THE INVENTION

It is therefore an object of this invention to provide a method for producing a corrosion resistant hot-dip coated steel sheet product having at least two highly formable side edge portions.

It is another object of this invention to provide a method for producing a highly corrosion resistant hot-dip steel sheet having good strength and stiffness characteristics along a central portion of the sheet extending between at least two softer more ductile side edge portions of the sheet.

It has been discovered that the foregoing objectives can be attained by heating the side edge portions of sheet to a higher temperature than the central portion of the sheet. The temperature differential across the width of the sheet will produce a sheet having side edge portions softer and more ductile than the hard, stiff central portion of the coated sheet.

DESCRIPTION OF A PREFERRED EMBODIMENT

Figure 1:
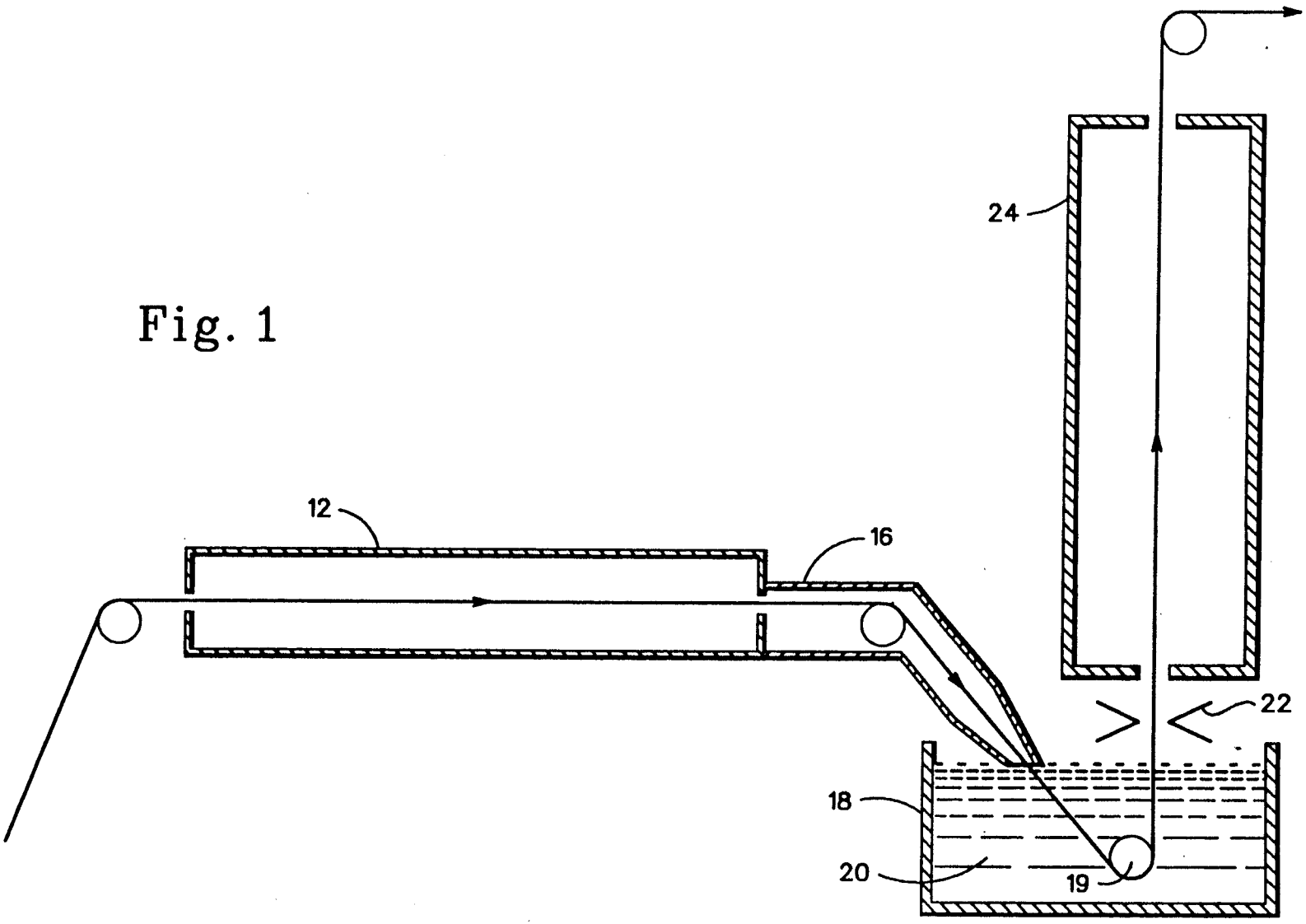
FIG. 1 is a schematic side elevation view of a continuous hot-dip coating lines as used to practice a preferred embodiment of this invention.

FIG. 1 illustrates a schematic side elevation of a hot-dip coating line using the "Non-Oxidizing Process" as described in U.S. Pat. No. 3,320,085.

In the hot-dip coating process as illustrated in FIG. 1, cold rolled low carbon steel sheet is withdrawn from a payoff reel (not shown), cleaned to remove oil and dirt, given a water rinse and then passed into a gas atmosphere fired furnace 12 having a reducing gas, such as hydrogen, which heats the sheet and reduces any remaining oxides. The sheet then passes into a protective hood 16 filled with hydrogen containing gas and from there into a heated pot 18 containing a molten coating metal 20. The sheet typically remains in the molten coating metal for a period of about 2–10, seconds and after passing around a submerged sinker roll 19 in the pot 18, emerges from the molten coating metal bath and passes between a pair of wiping dies 22 which produce a smooth uniform coating. The coated sheet then enters a cooling chamber 24 where the coating is cooled and solidified before the sheet is wound into a coil.

The preferred embodiment of this invention includes a hot-dip coating line similar to that shown in FIG. 1, and uses a coating metal 20 comprising an aluminum-zinc alloy consisting of 25–70% aluminum, about 1% silicon and the balance zinc. This type of hot-dip coating is further described in U.S. Pat. Nos. 3,343,930 and 3,393,089 to Borzillo, et al., but the invention can be applied to other types of hot-dip coatings as well.

In the past, coating a sheet with an aluminum-zinc alloy coating typically involved one of two methods to produce a uniformly hardened steel sheet product. The first method included the step of heating the sheet to a uniform temperature of about 10502° F. to produce a full-hard, high strength coated steel product. The second method included heating the sheet to a uniform temperature in the range of about 1250°-1300° F. to produce a more ductile commercial quality coated steel sheet product.

In accordance with this invention, selected gas burners within furnace 12 are adjusted to produce a sheet temperature of about 1250°-1300° F. along at least two opposed side edge portions of the sheet where higher sheet ductility properties are desired. The remaining gas burners, within furnace 12, are adjusted to produce a sheet temperature of about 1050° F. along the central portion of the sheet extending between the two more ductile sided edge portions. This temperature differential is maintained long enough to effect recrystallization of the steel sheet along the side edges, but not in the central portion of the sheet, and the resulting coated steel sheet product exhibits the unique property of having various controlled areas of different selected hardenability. More specifically, the resulting coated steel product comprises a central portion having a preferred hardness of at least 84 HRB, and at least two softer, opposed side edge portions having a hardness of less than 70 HRB.

While we prefer to heat the sides of the sheet to a higher temperature than the central portion of the sheet using the burners in furnace 12, the differential heating could be accomplished by other means such as electrical induction or resistance heaters that encompass only the side edge portions of the sheet, for example, in furnace 12.

Figure 2:
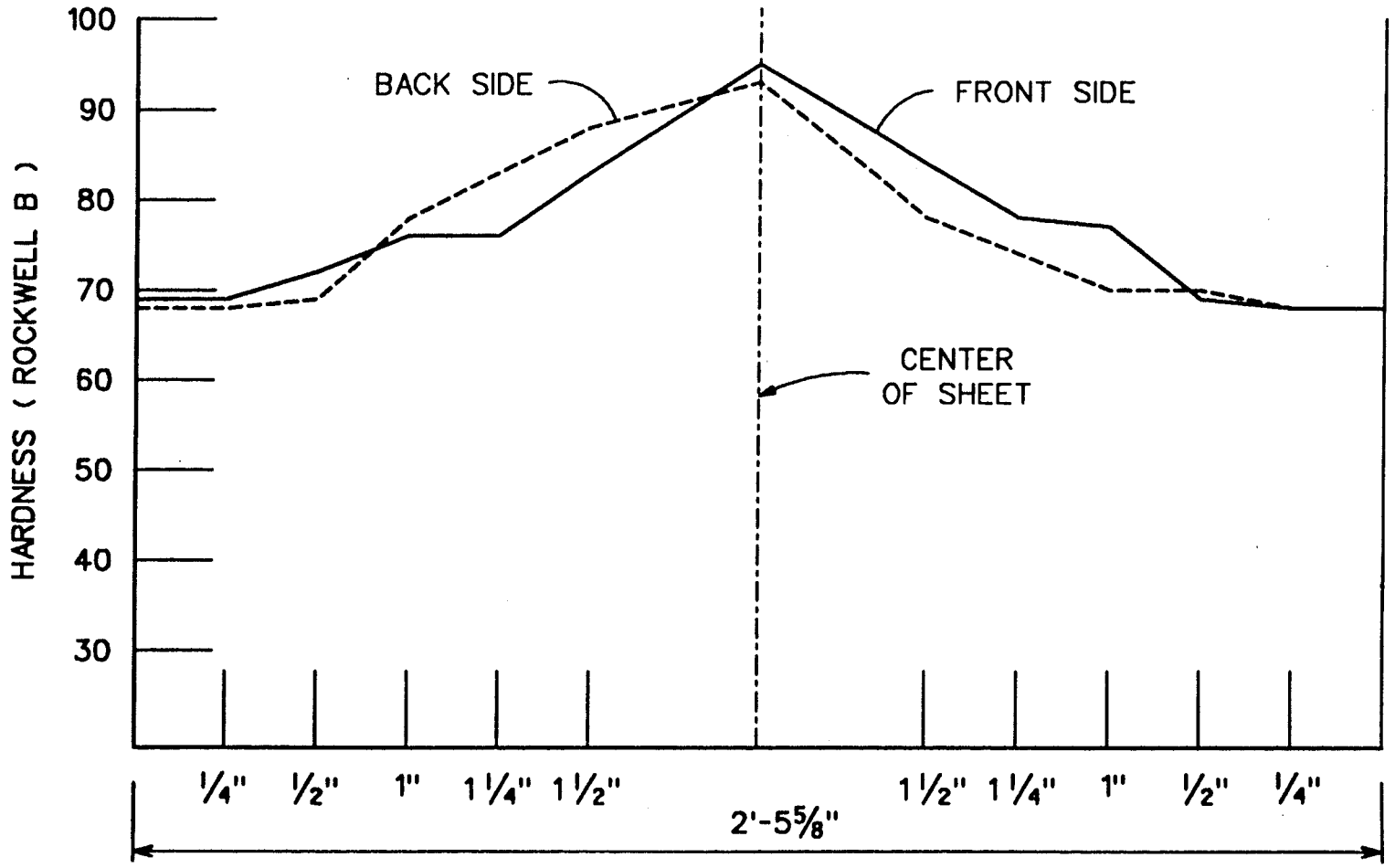
FIG. 2 is a graph plotting the hardness of a transverse section of hot-dip coated steel sheet made according to this invention.

FIG. 2 illustrates a hardness plot for both sides of a specific example of coated steel sheet product produced in accordance with this invention. The aluminum-zinc coated steel sheet shown in FIG. 2 means 29⅝" in width and has a thickness of 0.023" after coating. As can be seen, the full-hard properties of the sheet (at least 84 HRB) were maintained except for the outer inch or so at the side edges.

Coated steel sheet products produced according to this invention have many different useful applications. These sheet products are especially useful when they are formed into sheet metal roofing panels for buildings. The higher strength steel, extending along the central portion of these new variable hardness sheet metal roofing panels, allows for their use on longer roof spans as compared with the shorter span limits for older sheet metal roofing panels. Additionally, when these newer high strength roofing panels are used on older short span roofs, the thickness of the steel can be reduced with no loss to structural integrity.

It is anticipated that the variable hardness steel products, produced according to this invention, would also have applications as uncoated sheet. In such cases, the hot-dip coating, wiping, and cooling steps of the process could be eliminated. One such uncoated sheet application would be in the metal container industry for various container products such as steel drums. The full-hard central portion of the uncoated sheet would become the sidewall of the drum a lockseam for securing the top and bottom drum lids in place.

This invention could also have application to coated and uncoated nonferrous metal sheets, such as copper, zinc, aluminum, magnesium and their alloys since such sheets are also used in applications where a soft ductile side edge portion is desirable for forming operations and a hard stiff central portion is needed for stiffness and strength. Cold worked nonferrous metal sheets with also undergo a recrystallization when heated to a proper temperature similar to that described above in the case of steel sheet.

We claim:

1. A method of annealing a steel sheet, comprising the steps of:

a) providing a steel sheet having a central portion and oppositely disposed lateral edges; and b) differentially heating the full width of the sheet for a sufficient period so that the central portion attains a temperature sufficient to achieve a first hardness and the edges thereof attain a temperature sufficient to achieve a second hardness differing from said first hardness.

2. The method of claim 1, wherein said providing step comprises:

a) providing a steel sheet which is uncoated prior to being heated.

3. The method of claim 2, further including the step of:

a) hot-dip coating the sheet with a nonferrous metal after said heating step.

4. The method of claim 1, wherein said heating step comprises:

a) heating the sheet with one of gas burners or electric heaters.

5. The method of claim 4, including the step of:

a) heating the sheet with gas burners and adjusting the gas burners so that a sheet temperature of 1250° F. to 1300° F. is achieved in the edges and a sheet temperature of 1050° F. in the central portion.

6. The method of claim 1, wherein said heating step comprises:

a) heating the sheet so that the central portion attains a hardness exceeding the hardness of the edges.

7. The method of claim 6, including the step of:

a) heating the sheet sufficiently so that a Rockwell hardness of at least 84 HRB is achieved in the central portion and a Rockwell hardness of less than 70 HRB is achieved in the edges.

8. The method of claim 1, wherein said heating step comprises:

a) heating the edges to a temperature at least 200° F. higher than the temperature of the central portion.

9. The method of claim 8, including the step of:

a) heating the central portion to a temperature not exceeding 1050° F. and heating the edges to a temperature of from about 1250° F. to about 1300° F.

10. The method of claim 1, including the step of:

a) moving the sheet longitudinally relative to the heating means during said heating step.

11. The method of claim 1, wherein said heating step comprises:

a) heating the sheet for a period sufficient to effect recrystallization of the edges but not the central portion.

12. A method of annealing a metal sheet, comprising the steps of:

a) providing an uncoated metal sheet having a central portion and oppositely disposed lateral edges; and b) heating the full width of the sheet for a sufficient period so that the central portion attains a temperature sufficient to achieve a first hardness and the edges thereof to attain a temperature sufficient to achieve a second hardness differing from said first hardness.

13. The method of claim 12, further including the step of:

a) hot-dip coating the sheet with a nonferrous metal after said heating step.

14. The method of claim 12, wherein said heating step comprises:

a) heating the sheet with one of gas burners and electric heaters.

15. The method of claim 12, wherein said heating step comprises:

a) heating the sheet with gas burners and adjusting the gas burners so that a sheet temperature of 1250° F. to 1300° F. is achieved in the edges and a sheet temperature of 1050° F. is achieved in the central portion.

16. The method of claim 12, wherein said heating step comprises:

a) heating the sheet so that the hardness of the central portion exceeds the hardness of the edges.

17. The method of claim 16, including the step of:

a) heating the edges to a temperature at least 200° F. higher than the temperature of the central portion.

18. The method of claim 16, including the step of:

a) heating the sheet sufficiently to achieve a Rockwell hardness of at least 84 HRB in the central portion and a Rockwell hardness of less than 70 HRB in the edges.

19. The method of claim 12, wherein said heating step comprises:

a) heating the central portion to a temperature not exceeding 1050° F. and heating the edges to a temperature of from about 1250° F. to about 1300° F.

20. The method of claim 12, including the step of:

a) longitudinally moving the sheet relative to the heating means during said heating step.

21. The method of claim 12, including the steps of:

a) providing a steel sheet; and b) heating the sheet sufficiently to effect recrystallization of the steel sheet at the edges but not, at the central portion.

* * * * *